US005669755A

United States Patent [19]

Zahn

[11] Patent Number: 5,669,755

[45] Date of Patent: Sep. 23, 1997

[54] DEVICE FOR PRODUCING INDIVIDUAL STACKS OF SHEETS

[75] Inventor: Erich Michael Zahn, Eppelheim, Germany

[73] Assignee: Heidelberger Druckmaschinen AG, Heidelberg, Germany

[21] Appl. No.: 513,830

[22] PCT Filed: Jan. 27, 1994

[86] PCT No.: PCT/EP94/00219

§ 371 Date: Aug. 28, 1995

§ 102(e) Date: Aug. 28, 1995

[87] PCT Pub. No.: WO94/19270

PCT Pub. Date: Sep. 1, 1994

[30] Foreign Application Priority Data

Feb. 27, 1993 [DE] Germany ..... 43 06 219.9
Dec. 24, 1993 [DE] Germany ..... 43 44 361.3

[51] Int. Cl.[6] ..... B65G 57/03

[52] U.S. Cl. ..... 414/790.1; 414/789.5; 414/789.8; 414/790; 414/790.4; 414/793.4; 414/786

[58] Field of Search ..... 414/788.4, 789.5, 414/789.8, 789.9, 790, 790.1, 790.4, 792.8, 793.4, 794.1, 794.3, 797.9, 786

[56] References Cited

U.S. PATENT DOCUMENTS

| | | | |
|---|---|---|---|
| 3,231,100 | 1/1966 | Faeber . | |
| 3,938,674 | 2/1976 | Kroeze et al. . | |
| 3,980,183 | 9/1976 | Anikanov et al. . | |
| 4,195,963 | 4/1980 | Levkoff et al. | 414/790 |
| 4,255,074 | 3/1981 | Meratti et al. | 414/794.3 |
| 4,269,556 | 5/1981 | Martini . | |
| 4,983,096 | 1/1991 | Bodewein | 414/789.5 |
| 5,024,577 | 6/1991 | Miura | 414/788.4 |
| 5,135,351 | 8/1992 | Rathert | 414/793.4 |
| 5,372,472 | 12/1994 | Winski et al. | 414/789.9 |
| 5,375,967 | 12/1994 | Rathert | 414/789.5 |

FOREIGN PATENT DOCUMENTS

| | | |
|---|---|---|
| 942 213 | 4/1956 | Germany . |
| 24 52 920 | 4/1979 | Germany . |
| 27 53 048 | 5/1979 | Germany . |
| 27 58 291 | 6/1979 | Germany . |
| 35 07 009 | 9/1985 | Germany . |
| 60-248560 | 12/1985 | Japan . |
| 63-41359 | 2/1988 | Japan . |
| 2-119470 | 9/1990 | Japan . |
| 2 155 909 | 10/1985 | United Kingdom . |

OTHER PUBLICATIONS

Patent Abstract of Japan No. JP 1-313258 A (Yamamoto), Dec. 18, 1989.

*Primary Examiner*—David A. Bucci
*Assistant Examiner*—Douglas Hess
*Attorney, Agent, or Firm*—Herbert L. Ierner; Laurence A. Greenberg

[57] ABSTRACT

The invention relates to a device for the non-stop operation of a delivery unit of a rotary printing machine in which sheets in a flow of sheets are collated into individual stacks supported on a stack base with a surface interrupted by grooves and in which auxiliary stacks are borne by grid rods together forming a rack until their transfer to the stack base, the grid rods penetrating into the grooves during transfer. To prevent the stacks from being hampered by their weight, according to the invention a receiving plate catching the auxiliary stack from below is laid upon the grid rods in their reception position.

12 Claims, 1 Drawing Sheet

DEVICE FOR PRODUCING INDIVIDUAL STACKS OF SHEETS

The invention relates to a device for producing individual stacks of sheets from a downward-directed continuous stream of sheets consisting of consecutive sheets oriented more or less horizontally, with a stack-lifting device, said stack-lifting device comprising a lifting platform and a stack base positioned on the lifting platform: an auxiliary carrying device, said auxiliary carrying device comprising parallel grid rods together forming a rack, said grid rods being displaceable backwards and forwards between a standby position, provided outside the stream of sheets, and a reception position, situated inside the stream of sheets; and a stack-support surface formed on the stack base, said stack-support surface being penetrated by grooves, into which grooves the grid rods are retractable; with the grid rods in the reception position, the auxiliary carrying device temporarily carries a part-quantity of the sheets from the stream of sheets in the form of an auxiliary stack and, while moving the grid rods into their standby position, transfers said part-quantity to the stacklifting device; and wherein further sheets from the stream of sheets build up the auxiliary stack, transferred to the stack base, to form a stack of sheets. Such a device is known, for example, from the Japanese utility-model publication Hei 02-119470 (U), wherein the grooves in the stack-support surface prove advantageous inasmuch as, after the auxiliary stack has been brought down upon the stack-support surface, the rack can be withdrawn from under the auxiliary stack without reaction thereon. This advantage, however, is accompanied by a disadvantage that becomes noticeable particularly in the case of sheets that are of a low weight with reference to their surface area. Said disadvantage consists in the fact that, as the height of the deposited auxiliary stack increases, the grooved carrying portion of the stack-support surface presses into the underside of said auxiliary stack.

The invention is intended to design a device of the above-mentioned kind such that there are no adverse effects on sheets that have been superposed to form a stack of sheets, said adverse effects stemming from the weight of the stack of sheets. The object of the invention is achieved by a device which a receiving plate, catching the auxiliary stack from below, is laid upon the grid rods in their reception position.

With a receiving plate as provided according to the invention, a bottom-most sheet of an auxiliary stack is presented with a flat, closed support surface in the nature of a plate. Consequently, there is no adverse effect owing to the increasing weight of a stack of sheets formed of consecutive sheets, such adverse effect occurring in known devices of the above mentioned kind in that, in such devices, the stack rests on a discontinuous stack-support surface.

The receiving plate can be laid on the grid rods either manually or by means of an automatic device. It is advantageous for the size of the receiving plate to be slightly greater than the size of the sheets of which respective stacks of sheets are formed. It may also be advantageous to coordinate the size of the receiving plate with the maximum size of the sheets that are to be stacked in the device. As for the rest, the dimensioning is coordinated with the material selected for the receiving plate and with the weight of a stack of sheets ultimately resting on the receiving plate.

A first embodiment of a device according to the invention is characterized in that, after transfer of each auxiliary stack to the stack-lifting device, a receiving plate catching the auxiliary stack from below is brought down upon the stack-support surface of an empty waiting stack base.

This embodiment may be advantageously used in those cases in which the sheets of a stack of sheets built up on a flat, closed support surface do not adversely affect each other with increasing stack height. Consequently, a corresponding area of application is provided, for example, by a non-stop stacking device for sheets output from a printing press, said sheets having no adverse effect on each other through ink deposition, given a system-inherent maximum height of a homogeneous stack of sheets.

A further embodiment of a device according to the invention is characterized in that, after transfer of a first auxiliary stack to the stack-lifting device, a first receiving plate catching the first auxiliary stack from below is brought down upon the stack-support surface of an empty waiting stack base: by means of a further part-quantity of the sheets of the stream of sheets, the first auxiliary stack, brought down upon the stack-support surface, is formed into a first part-stack; known stack-supporting elements of a height greater than that of the first part-stack are brought down upon the first receiving plate: and, after transfer of the second auxiliary stack to the stack-lifting device, a second receiving plate catching the second auxiliary stack from below is brought down upon the stack-supporting elements.

This embodiment may be advantageously used in those cases in which the sheets of a stack of sheets built up on a flat, closed support surface adversely affect each other starting from a specific height of said stack of sheets. Consequently, a corresponding area of application is provided, for example, by a non-stop stacking device for sheets output from a printing press where there is the risk with such sheets that, starting from a specific height of a stack of sheets formed of such sheets, printing ink may be set off from one sheet onto an adjacent sheet. In such a case, the second receiving plate and, where applicable, further receiving plates then serve as hurdle plates for a delivery unit of the printing press, said delivery unit operating in so-called hurdle mode. A particular advantage in this regard is the fact that it is possible to dispense with the need for additional guides for the temporary holding of hurdle plates and therefore also with the need for means for releasing the hurdle plates from the guides after the hurdle plates have been laid down upon the supporting elements.

In a further development of the subject matter of the invention, it is provided that a magazine, containing a plurality of superposed receiving plates, is disposed above the grid rods while said grid rods are in the standby position, from which magazine the bottom-most of the receiving plates is removable—in the course of a longitudinal displacement of the grid rods in an insertion direction directed towards the stream of sheets—by means of a driving arrangement provided on the rack, with said bottom-most receiving plate being deposited on the grid rods.

In conjunction with automatic displacement means (known, for example, from the initially mentioned publication Hei 2-119 470 (U)), said displacement means displacing the grid rods in and opposite to the insertion direction, in this further development of the subject matter of the invention the grid rods already form, together with their displacement means, active parts of an automatic loading device for loading a stacking device (operating, for example, in hurdle mode) with hurdle plates.

In an advantageous embodiment of the subject matter of the invention, it is provided that the auxiliary carrying device is height-adjustable.

This also allows, in particular, the grid rods to move away from a receiving plate, said receiving plate being positioned on the stack-supporting elements after an auxiliary stack has been transferred to the stack-lifting device, with the result that, after the aforementioned transfer, the grid rods can, without reaction on the auxiliary stack, be displaced from their reception position into their standby position.

An advantageous embodiment of the subject matter of the invention is characterized in that provided on a first end face of the magazine facing the stream of sheets is a distribution opening, said distribution opening exposing a front end face of the bottom-most receiving plate; at least one second opening of the magazine, situated opposite the distribution opening, and, in a floor of the magazine carrying the receiving plates, at least one third opening are provided, where in the driving arrangement—in the course of the longitudinal displacement of the grid rods directed towards the stream of sheets—reaches through the second and third openings into the magazine: and in that the driving arrangement comprises at least one stop surface, said stop surface being perpendicular to the grid rods and pointing in the insertion direction and—in the course of the longitudinal displacement of the grid rods directed towards the stream of sheets—engaging a rear end face of the bottom-most receiving plate.

In a further advantageous embodiment of the subject matter of the invention, a displacement device is provided, said displacement device automatically displacing the grid rods in their longitudinal direction.

A further advantageous embodiment is characterized in that the driving arrangement is furnished with a spring arrangement, said spring arrangement having the tendency to hold a top edge of the stop surface on a first level with respect to the grid rods: and in that the second opening, situated opposite the distribution opening, is associated with a height-adjustable guiding device, by means of which guiding device the top edge of the stop surface is lowerable onto a lower second level with respect to the grid rods.

A further preferred embodiment consists in that the distribution opening is adapted to be set, by means of adjustable distribution lugs, to the thickness of the receiving plates contained in the magazine.

Particularly with a view to the further treatment of a stack of sheets subsequent to the formation of the stack of sheets, a further preferred embodiment provides that releasable connecting means are provided, said connecting means locating the receiving plate (having been brought down upon the stack base) on the stack base. This measure is advantageous, for example, in cases where the sheets of a stack of sheets seated, with the interposition of the receiving plate, on the stack base are singled, for example by means of a suction device, and removed from the stack. In such a case, the releasable connecting means ensure that the receiving plate remains in any event on the stack base and is not lifted off by the suction device.

Hereinbelow, the invention is described in greater detail on the basis of specimen embodiments with reference to the drawings, in which.

Figure 1:
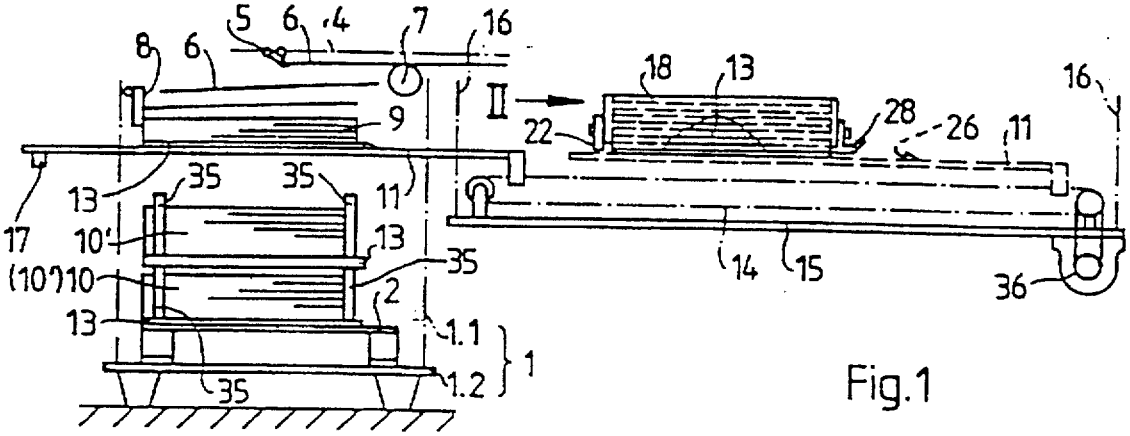
FIG. 1 shows a schematic representation of a device according to the invention with an automatic device for laying the receiving plate upon the grid rods.

In the specimen embodiment shown in FIG. 1, flat pallet 1.2 suspended on lifting chains 1.1 is provided as the lifting platform 1 of a stack-lifting device, said flat pallet 1.2 being able, by means of the lifting chain 1.1, to be raised as required to a defined upper level and to be lowered to a defined lower level and, in the representation shown, being at its lowermost level. The lifting platform 1 carries a stack base 2 in the form of a further flat pallet with a stack-support surface 2.1 interrupted by parallel grooves 2.2 (see FIG. 5).

A downward-directed, continuous stream of sheets, to be collated into individual stacks and consisting of more or less horizontally oriented, consecutive sheets, is output, for example, from a chain delivery unit of a sheet-fed rotary printing press. A part of corresponding delivery chains 4 is shown as a dash-dotted line in FIG. 1. Gripper devices 5, carried by such delivery chains, transport consecutive sheets 6 in known manner at printing press speed, usually through the intermediary of a suction roller 7, towards front-edge stop 8 and release the respective sheet 6 at a defined distance before the front-edge stop the result that the respective sheet, oriented more less horizontally and braked by the suction roller 7, moves towards the front-edge stop 8 while simultaneously falling and forms a stack 10, which is successively built up from an auxiliary stack 9.

In FIG. 1, the lifting platform 1 is shown in a removal position, in which the flat pallet 1.2 of the lifting platform 1 is at its lowermost level. From this removal position, an individual stack 10 or part-stacks 10' positioned one on top of the other in hurdle formation can, together with the stack base 2, be transported away out of the region of the device. After such transporting away an empty stack base 2 is laid upon the flat pallet 1.2 in order to receive a further stack formed from the stream of sheets. Such a further stack is received after the flat pallet 1.2 and, therefore, the empty stack base 2 have been raised to an upper level, at which the stack base 2 cooperates with an auxiliary carrying device and, more specifically, takes over the auxiliary stack 9 carried by the auxiliary carrying device, said auxiliary stack 9 being formed from a part-quantity of the stream of sheets during the disposal of the flat pallet 2 (holding an individual stack 10 or part-stacks 10' in hurdle position) through lowering and transporting away of said flat pallet 2 and during the making-ready of an empty stack base 2 and raising thereof to the aforementioned upper level.

The auxiliary carrying device provided for the temporary carrying of the auxiliary stack 9 formed of said part-quantity comprises in known manner parallel grid rods 12 together forming a rack 11. Said grid rods 12 are displaceable between a standby position outside the stream of sheets (represented by broken lines in FIG. 1) and a reception position inside the stream of sheets (represented by solid lines) and, moreover, are formed and disposed in such a manner that they are retractable into the grooves 2.2 of the stack base 2, said grooves 2.2 being visible in FIG. 5.

Whereas, in conventional devices of this kind, the lowermost sheet of the auxiliary stack 9 is deposited directly onto the grid rods 12, the invention provides a receiving plate 13, said receiving plate 13 resting directly on the grid rods 12 and catching the auxiliary stack 9 from below, said auxiliary stack 9 being formed successively from the sheets of the stream of sheets. Said receiving plate is then deposited jointly with a first auxiliary stack 9 onto the stack base 2, this taking place at the instant in which said stack base 2 is raised to the aforementioned upper level, at which it cooperates with the auxiliary carrying device. Such cooperation takes place in known manner in that the grid rods 12 penetrate into the grooves 2.2 of the stack base 2 (which has been moved towards the upper level). In the device according to the invention, such penetration takes place until there is mutual contact between stack base 2, on the one hand, and receiving plate 13, on the other hand. With the establishment of such contact, the receiving plate 13 now rests on the stack base 2 and no longer rests on the grid rods 12, with the result that the receiving plate 13 only temporarily rests on the grid rods 12. Following the mutual contacting of stack base 2 and receiving plate 13, the grid rods 12 are withdrawn into their standby position (position shown by broken lines in FIG. 1).

Having thus been transferred to the stack base 2, the receiving plate 13 may now receive an individual stack 10 in the form of a total stack or may receive individual stacks 10' in hurdle formation, a total stack being a stack in which the sheets forming said stack are superposed one on top of the other, in particular up to a height at which optimal use has been made of the available space below the grid rods 12 in their reception position.

As is apparent, FIG. 1 shows an embodiment of the subject matter of the invention with which individual stacks 10' of sheets are formed in hurdle formation. In this representation, a first receiving plate 13 (deposited initially onto the grid rods 12 and catching a first auxiliary stack 9 from below) is laid directly onto the stack base 2 and carries a part-stack 10 as well as stack-supporting elements 35, which are of a height greater than that of the part-stack 10'. Further receiving plate 13 (deposited initially onto the grid rods 12 and catching a further auxiliary stack 9 from below) is then laid upon said stack-supporting elements 35 for example by hand.

In the embodiment shown in FIG. 1, the auxiliary carrying device, comprising the rack 11, is, in turn, height-adjustable. This is schematically represented in the form of a frame 15, said frame 15 carrying a displacement device 14 for the rack 11 and, similarly to the flat pallet 1.2, being suspended on further lifting chains 16. Consequently, the auxiliary stack 9, too, is able—during its building-up, during deposition onto the stack base 2 and during displacement of the grid rods 12 from their reception position into their standby position—to be lowered in order to compensate for the continuous increase in the height of the stack. Furthermore, the height-adjustability of the auxiliary carrying device also allows the obstruction-free return of the grid rods 12 from a position retracted into the grooves 2.2 into the standby position of the grid rods 12.

The auxiliary carrying device also comprises a cross-member 17, said cross-member 17 being likewise height adjustable and being visible in cross section in FIG. 1. Said cross-member 17 supports the free ends of the grid rods 12 in their reception position. The known means for the height adjustment of the crossmember 17 are not shown.

In FIG. 1, the displacement device 14 is indicated merely by way of example in the form of a transmission drive, said transmission drive being driven by means of a servo-motor 36. Consequently, there is provided an automatic displacement device which, together with hereinbelow described magazine 18, constitutes a device that automatically lays the receiving plate 13 onto the grid rods 12.

The magazine 18 is disposed above the grid rods 12 when in their standby position and contains a plurality of receiving plates 13 superposed one on top of the other therein. In the course of a longitudinal displacement of the grid rods 12 directed in an insertion direction towards the stream of sheets, the bottom-most of the receiving plates 13 is removed from said magazine 18 by the rack 11 by means of a driving arrangement (provided on the rack 11 and described in greater detail hereinbelow), with the removed receiving plate 13 being deposited on the grid rods 12.

Figure 2:
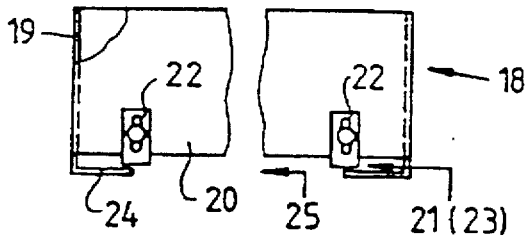
FIG. 2 shows a view in the direction of arrow II in FIG. 1 of a magazine used in the specimen embodiment for a plurality of receiving plates.

Basically, the magazine 18 has the form of a rectangular box with a pair of side walls 19 extending along the insertion direction. It is advantageous for the inside dimension between the side walls 19 to be such that the latter constitute guiding surfaces for end faces (extending in the insertion direction) of the receiving plates 13 held in the magazine 18. As is best apparent from FIG. 2, the magazine 18 has, on a first end face 20 facing the stream of sheets, a distribution opening 21, said distribution opening 21 exposing a front end face of the bottom-most receiving plate 13. Said distribution opening 21 is adapted to be set, by means of adjustable distribution lugs 22, to the thickness of the receiving plates 13 contained in the magazine 18. In the present specimen embodiment, such a distribution lug 22 is in the form of a strap provided with an oblong hole and bolted to the first end face 20 of the magazine 18, the height of said strap being settable through the intermediary of the oblong hole. It is advantageous for the distribution opening 21 to be of a height that is slightly greater than the thickness of each of the receiving plates 13 in the magazine 18.

In addition, the magazine 18 has a second opening 23, opposite the distribution opening 21, and, in a floor 24 of the magazine carrying the receiving plates 13, a third opening 25. The distribution opening 21, the second opening 23 and the third opening 25 form a continuous cutout, which is most clearly visible in FIG. 2. Consequently, the entire front end face of the bottom-most receiving plate 13, at least a part of the rear end face thereof and at least a part of the underside thereof extending from the front to the rear end face are freely accessible. This free accessibility is provided in order to allow the driving arrangement (disposed on the rack 11 and already mentioned hereinbefore) to reach into the interior of the magazine 18. This reaching into the interior of the magazine 18 takes place in the course of the longitudinal displacement of the grid rods 12 directed towards the stream of sheets. For this purpose, the driving arrangement comprises at least one stop surface 26, said stop surface 26 being perpendicular to the grid rods 12 and pointing in the insertion direction and, in the course of the aforementioned longitudinal displacement, engaging the rear end face of the bottom-most receiving plate 13 and pushing said receiving plate 13 out of the magazine 18 through the distribution opening 21 and into the stream of sheets, said bottom-most receiving plate 13 being deposited upon the grid rods 12. The deposition of the bottom-most receiving plate 13 on the grid rods 12 may, depending on the positioning of said grid rods 12, take place successively or may already be the case from the outset in the standby position of the grid rods 12. In the latter case, the grid rods 12 (as shown in the specimen embodiment according to FIG. 1) are, when in their standby position, in contact with the underside of the bottom-most receiving plate 13. Depending on the type of such deposition, a top edge 27 of the stop surface 26 must be provided at a defined level with respect to the grid rods 12.

Figure 3:
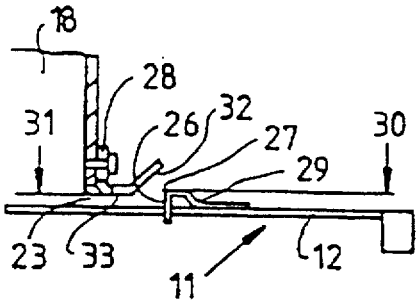
FIG. 3 shows a detail of a specimen embodiment, said detail illustrating the interplay between a spring-loaded driving arrangement and a guiding arrangement on the magazine.
Figure 4:
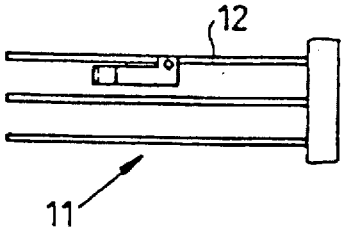
FIG. 4 shows a top view of the driving arrangement shown in FIG. 3.

FIG. 3 shows a variant of the driving arrangement and the interplay thereof with a guiding device 28 on the magazine 18. In this connection, the driving arrangement is furnished with a spring arrangement 29, said spring arrangement 29 having the tendency to hold the top edge 27 of the stop surface 26 on a first level 30 with respect to the grid rods 12. In the specimen embodiment shown, a corresponding stop surface 26 is formed for this purpose onto a curved part of a leaf spring, said leaf spring being joined, for example by spot-welding, to a grid rod 12. This driving arrangement cooperates with the aforementioned guiding device 28, which is associated with the second opening 23 of the magazine 18 situated opposite the distribution opening 21. By means of said guiding device 28, the top edge 27 of the stop surface 26 of the driving arrangement is lowerable, in opposition to the action of the spring arrangement 29, from the first level 30 with respect to the grid rods 12 to a corresponding lower second level 31, the second level 31 being adjustable with respect to the magazine 18 through a height adjustment of the guiding device 28 and advantageously being somewhat below a top side of the bottom-most receiving plate 13. For the height adjustment of the guiding device 28, said guiding device 28 may, as shown by way of example in FIG. 3, be connected to the magazine 18 In similar manner to the distribution lugs 22 by means of combinations of oblong hole on the guiding device 28 and fixing bolt penetrating the oblong hole.

The guiding device 28 provided comprises, in particular, a first guiding surface 32, said guiding surface 32 being downward-inclined towards the second opening 23 and falling to the second level 31. In the course of the longitudinal displacement of the grid rods 12 in the insertion direction, the top edge 26 of the driving arrangement, which is originally at the first level 30, is pressed down onto the lower second level 31 by said first guiding surface 32 in opposition to the action of the spring arrangement 29. In the specimen embodiment shown, the first guiding surface 32 is adjoined at the second level 31 by a horizontal second guiding surface 33, which, however, is dispensable in the case of appropriate placing of the first guiding surface 32 with respect to the second opening 23 of the magazine 18. Consequently, the combination of such a guiding device 28 and such a driving arrangement furnished with a spring arrangement 29 permits the driving arrangement to be adapted to different thicknesses of the receiving plates 13.

Figure 5:
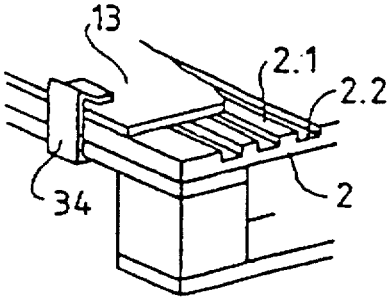
FIG. 5 shows a specimen embodiment of a receiving plate located on the stack base by means of releasable connecting means.

In the specimen embodiment shown in FIG. 5, spring-loaded clamps are provided as the releasable connecting means 34 for locating the receiving plate 13, said receiving plate 13 having been placed onto the stack base 2. However, said spring-loaded clamps are only representative of releasable connecting means for locating a plate on a base.

It is advantageous for the box-like magazine 18 to be open on its top side, so that it can be loaded from there with receiving plates 13.

If, as is assumed in the present case, the stream of sheets is output from the chain delivery unit of a sheet-fed rotary printing press, then it is advantageous for the grid rods 12 (when in their standby position) and therefore also the magazine 18 to be in a position (as viewed in the delivery direction of the chain delivery unit) in front of the individual stacks that are to be formed. Consequently, the magazine 18 is situated between the grid rods 12, on the one side, and the lower side of the delivery chain 4, on the other side. With a view to improved accessibility of the magazine 18 for loading thereof with receiving plates 13, therefore, it is advantageous for the magazine 18 to be displaceably disposed transversely with respect to the delivery direction. The nature and dimensioning of the receiving plates 13, in turn, may, within the scope of the invention, be adapted to the particular intended purpose of said receiving plates 13, different intended purposes resulting, in particular, through the use of the receiving plates 13 for the formation of individual stacks 10 in the form of the aforementioned total stacks, on the one hand, and the aforementioned partstacks 10', on the other hand.

I claim:

1. Device for producing individual stacks of sheets from a continuous, downwardly directed stream of sheets formed of consecutively arriving, substantially horizontal sheets, comprising:

a stack lifting device with a lifting platform and a stack base disposed on said lifting platform;

an auxiliary carrying device with a plurality of mutually parallel grid rods together forming a rack, said rack being displaceable back and forth between a standby position outside a stream of sheets, and a receiving position inside the stream of sheets; and a stack support surface formed on said stack base, said stack-support surface having mutually parallel grooves formed therein for receiving said grid rods;

wherein, when said rack is in the receiving position, said auxiliary carrying device temporarily carries an auxiliary stack formed of a partial quantity of sheets from the stream of sheets, and when said rack moves into the standby position, said rack transfers the auxiliary stack to said stack lifting device; and wherein further sheets from the stream of sheets build up the auxiliary stack, transferred to said stack lifting device, to form a stack of sheets; and a horizontally oriented receiving plate movable by said auxiliary carrying device between a position outside the stream of sheets into a receiving position inside the stream of sheets; said receiving plate being provided in addition to said stack base, the plate having a plane, a closed stack-support surface, and being movable independently of said stack base; and said rack carrying said receiving plate until the auxiliary stack is transferred to said stack lifting device.

2. The device according to claim 1, wherein said receiving plate is placed on said stack-support surface of said stack base after the transfer of each auxiliary stack to said stack lifting device.

3. The device according to claim 1, wherein said receiving plate is one of a plurality of receiving plates, and which further comprises a magazine receiving said plurality of said receiving plates superposed on one another, said magazine being disposed so that said grid rods, in said standby position of said rack, are disposed beneath said magazine, and a catch means is disposed at said rack for removing from said magazine a lower-most of said receiving plates and depositing said lower-most receiving plate on said grid rods.

4. The device according to claim 3, wherein said magazine has an apportionment opening formed in a first end face thereof facing the stream of sheets, and a front end face of said lowermost receiving plate being exposed at said apportionment opening;

said magazine having at least one second opening formed opposite said apportionment opening, and at least one third opening formed in a floor of said magazine, said floor carrying said receiving plates, said catch means, during a longitudinal displacement of said grid rods towards the receiving position, reaching through said second and third openings into said magazine;

said catch means comprising at least one stop surface disposed on said rack, said stop surface being oriented perpendicular to said grid rods and facing towards an insertion direction defined by an insertion of said grid rods from said standby position into said receiving position, and said stop surface engages a rear end face of the lower-most receiving plate while said rack is moved into the receiving position.

5. The device according to claim 4, wherein said catch means includes a spring configuration, said spring configuration resiliently holding a top edge of said stop surface on a first level with respect to said grid rods;

and a height-adjustable guiding device associated with said second opening situated opposite said apportionment opening, said guiding device lowering said top edge of said stop surface onto a second level lower than said first level.

6. The device according to claim 4, wherein said receiving plates have a given thickness, and the magazine further includes apportionment lugs associated with said apportionment opening, the lugs for adapting said apportionment opening to the given thickness of said receiving plates contained in said magazine.

7. The device according to claim 1, wherein said auxiliary carrying device is height-adjustable.

8. The device according to claim 1, which further comprises a displacement device for automatically displacing said grid rods in a longitudinal direction thereof.

9. The device according to claim 1, which further comprises releasable connecting means adapted for releasably connecting said receiving plate with said stack base.

10. A method of forming individual stacks of sheets in a sheet-processing machine, wherein the stacks of sheets are formed from a continuous, downwardly directed stream of substantially horizontal sheets consecutively arriving at a device for forming the stacks of sheets;

the device comprising a stack lifting device with a lifting platform and a stack base disposed on the lifting platform; an auxiliary carrying device with a rack; the rack formed with a plurality of mutually parallel grid rods; and a stack support surface formed on the stack base, the stack support surface having mutually parallel grooves formed therein for receiving the grid rods of the rack;

the method which comprises:

displacing the rack between a standby position outside the stream of sheets and a receiving position inside the stream of sheets; and moving the rack into the receiving position and temporarily carrying, with the auxiliary carrying device, an auxiliary stack formed of a partial quantity of sheets from the stream of sheets;

moving the rack into the standby position and transferring the auxiliary stack to the stack lifting device; and subsequently further building the auxiliary stack with further sheets arriving in the stream of sheets and forming a full stack of sheets;

moving, with the auxiliary carrying device, a horizontally oriented receiving plate independently of the stack base between a position outside the stream of sheets into a position inside the stream of sheets; and carrying, with the rack, the receiving plate until the auxiliary stack is transferred to the stack lifting device.

11. The method according to claim 10, which further comprises:

placing a first receiving plate loaded with a first auxiliary stack on the stack support surface of an empty stack base by transferring said first auxiliary stack to the stack lifting device;

forming a first partial stack by placing a further partial quantity of the sheets from the stream of sheets on the first auxiliary stack located on the stack-support surface;

placing stack-supporting elements of a height greater than a height of the first partial stack on the first receiving plate; and transferring said second auxiliary stack to the stacklifting device, subsequently placing a further receiving plate supporting a second auxiliary stack on the stack-supporting elements by transferring a second auxiliary stack to the stack lifting device.

12. The method according to claim 10, which further comprises placing a plurality of mutually superposed receiving plates in a magazine disposed so that said grid rods, in the standby position thereof, are disposed beneath said magazine, removing a lower-most of the receiving plates from the magazine with a catch means disposed on said rack by longitudinally displacing the grid rods in an insertion direction towards the receiving position, and depositing the lower-most receiving plate on the grid rods.

* * * * *

UNITED STATES PATENT AND TRADEMARK OFFICE

CERTIFICATE OF CORRECTION

PATENT NO. : 5,669,755
DATED : September 23, 1997
INVENTOR(S) : Erich Michael Zahn It is certified that error appears in the above-identified patent and that said Letters Patent is hereby corrected as shown below:

Column 10,
Line 28, eliminate "transferring said second auxiliary stack to the stack lifting device"
Line 31, "a" should be replaced with -- said -- so that the sentence reads:
supporting elements by transferring said auxiliary stack lifting device.

Signed and Sealed this

Third Day of December, 2002

JAMES E. ROGAN
*Director of the United States Patent and Trademark Office*